US008156612B2

(12) United States Patent
Yamashita

(10) Patent No.: US 8,156,612 B2
(45) Date of Patent: Apr. 17, 2012

(54) ANGLE-ADJUSTABLE HINGE

(75) Inventor: Tadanobu Yamashita, Sakai (JP)

(73) Assignee: Koyo Giken Kabushiki Kaisha, Sakai-shi (JP)

( * ) Notice: Subject to any disclaimer, the term of this patent is extended or adjusted under 35 U.S.C. 154(b) by 190 days.

(21) Appl. No.: 12/707,186

(22) Filed: Feb. 17, 2010

(65) Prior Publication Data

US 2010/0293748 A1 Nov. 25, 2010

(30) Foreign Application Priority Data

May 22, 2009 (JP) ..... 2009-124333

(51) Int. Cl.
*E05D 7/00* (2006.01)

(52) U.S. Cl. ..... 16/354; 16/239; 16/249; 16/324; 403/93; 297/366

(58) Field of Classification Search ..... 16/354, 16/235, 239, 249, 321, 324, 326–327, 334; 403/91–94, 96–98; 297/354.12, 364–366, 297/374

See application file for complete search history.

(56) References Cited

U.S. PATENT DOCUMENTS 3,848,923 A * 11/1974 Dehler ..... 297/366
3,887,232 A * 6/1975 Dinkel ..... 297/367 R
4,082,352 A * 4/1978 Bales et al. ..... 297/364
4,133,578 A * 1/1979 Fancy ..... 297/370
5,146,808 A * 9/1992 Hoshino ..... 74/531
6,565,156 B1 * 5/2003 Yamashita et al. ..... 297/354.12
6,926,363 B2 * 8/2005 Yamashita ..... 297/366
6,993,808 B1 * 2/2006 Bennett et al. ..... 16/334
7,150,073 B2 * 12/2006 Stewart ..... 16/354
7,984,531 B2 * 7/2011 Moore ..... 16/326
2009/0288270 A1 * 11/2009 Yamashita ..... 16/239

FOREIGN PATENT DOCUMENTS

JP 3766669 B2 2/2006

* cited by examiner

*Primary Examiner* — William L. Miller
(74) *Attorney, Agent, or Firm* — Kratz, Quintos & Hanson, LLP

(57) ABSTRACT

An angle-adjustable hinge provided with a first member provided with a case portion holding an approximately disc-shaped gear member having a non-circular through hole as to freely rotate, a second member having a fitting shaft portion detachably inserted to the through hole of the gear member, a wedge-shaped window portion formed on the case portion, and a floating wedge member, movably disposed within the wedge-shaped window portion, in which one side face is a toothed face to engage with the gear member and another side is a contact face to contact a wedge face of the wedge-shaped window portion, to restrict the gear member from oscillation in one direction against the case portion by the engagement of the toothed face with the gear member and the contact of the contact face and the wedge face.

6 Claims, 16 Drawing Sheets

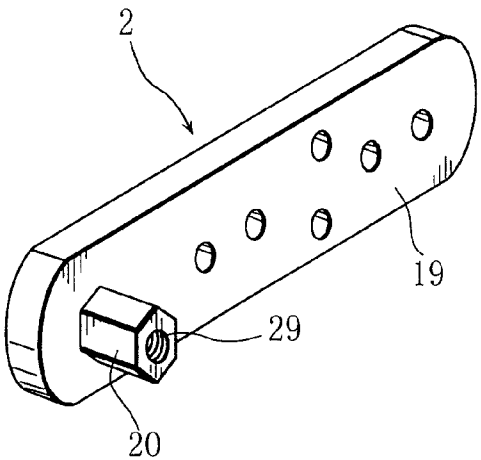
FIG. 3
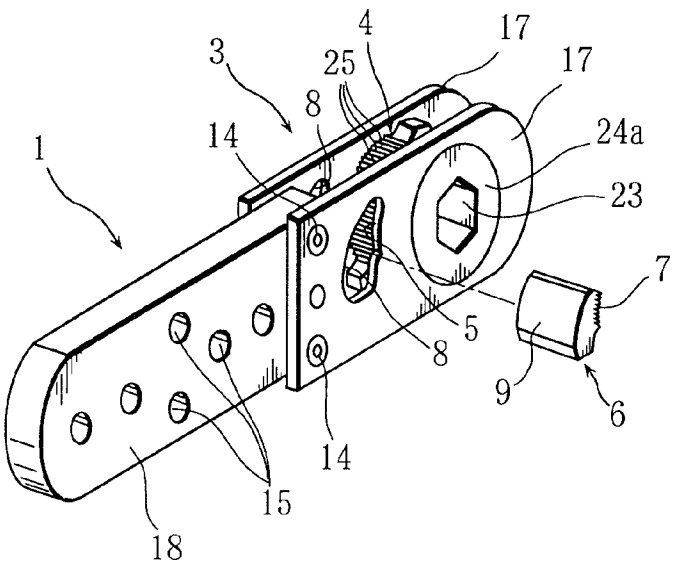

ANGLE-ADJUSTABLE HINGE

BACKGROUND OF THE INVENTION

1. Field of the Invention

This invention relates to an angle-adjustable hinge used for furniture with which a back is pivoted as to adjust an inclination angle of the back.

2. Description of the Related Art

The inventor of the present invention has been proposed various inventions relating to angle-adjustable hinges of this kind. For example, as shown in an assembly view of FIG. 17 and an exploded view of FIG. 18 (refer to Japanese patent No. 3766669), an angle-adjustable hinge 43 is constructed that a second arm 32 having an arc-shaped gear portion 34 of a first arm 31 forming a case portion 33 is provided, wedge-shaped window portions 35 are formed on plate piece portions 37, a floating wedge member 36 is inserted to the wedge-shaped window portions 35, the gear portion 34 of the second arm 32 and two parallel plate piece portions 38 are inserted between the two parallel plate piece portions 37 of the case portion 33, and a small pin 39 is inserted to small holes 40 and 41 to connect the first arm 31 and the second arm 32 as to oscillate around an axis 42.

The gear portion 34 has many fine gear teeth 48, the floating wedge member 36 also has fine gear teeth 49. If these gears are not certainly engaged with high dimensional accuracy, contact pressure on the gear teeth 48 and 49 becomes excessive, and cutting and rapid abrasion may be generated.

However, the angle-adjustable hinge shown in FIGS. 17 and 18 has problems described below.

(i) The gear teeth 48 of the gear portion 34 and the gear teeth 49 of the wedge member 36 engage when two independent parts (the first member 1 and the second member 2) are assembled with the small pin 39. In the assembly, dimensional errors are accumulated, contact pressure on the gear teeth 48 and 49 in use becomes high, and early abrasion and cutting of the gear teeth may be generated.

(ii) The assembly work is difficult because many small parts must be assembled as shown in FIG. 18.

(iii) The first member 1 and the second member 2 respectively have a circular pipe portion 50 formed by plastic work into a short cylinder, and use of these members assembled as in FIG. 17 is limited. That is to say, when these members are used for a chair, they are exclusively used for the chair. For other kinds of furniture, plate materials of various configurations are required for the circular pipe portion 50. Especially, when the pipe portion 50 is made plate-shaped, angled, and a bent arm, new design and production are required for each of the configurations.

(iv) Further, oscillation start angle and oscillation end angle of the first arm 31 and the second arm 32 are determined and unchanged to other angles.

(v) Therefore, for use in which another oscillation start angle and another oscillation end angle are required (use of different kind of furniture such as a sofa, a bed, a chair, etc. and different inclination conditions), different design and production are required.

(vi) It is difficult to keep the dimensional accuracy in assembled state and assembly defection may be generated because main functional parts which require high accuracy are separated into the first arm 31 and the second arm 32.

(vii) The entire load works on the small pin 39, and early abrasion and crush on the small pin 39 and the small hole 41 tend to be generated.

Therefore, it is an object of the present invention to provide an angle-adjustable hinge with which the problems (i) to (vii) described above are solved.

BRIEF DESCRIPTION OF THE DRAWINGS

The present invention will be described with reference to the accompanying drawings, in which:

FIG. 3 is an exploded perspective view of a principal portion of the angle-adjustable hinge;

PREFERRED EMBODIMENTS OF THE INVENTION

Preferred embodiments of the present invention will now be described with reference to the accompanying drawings.

Figure 6A:
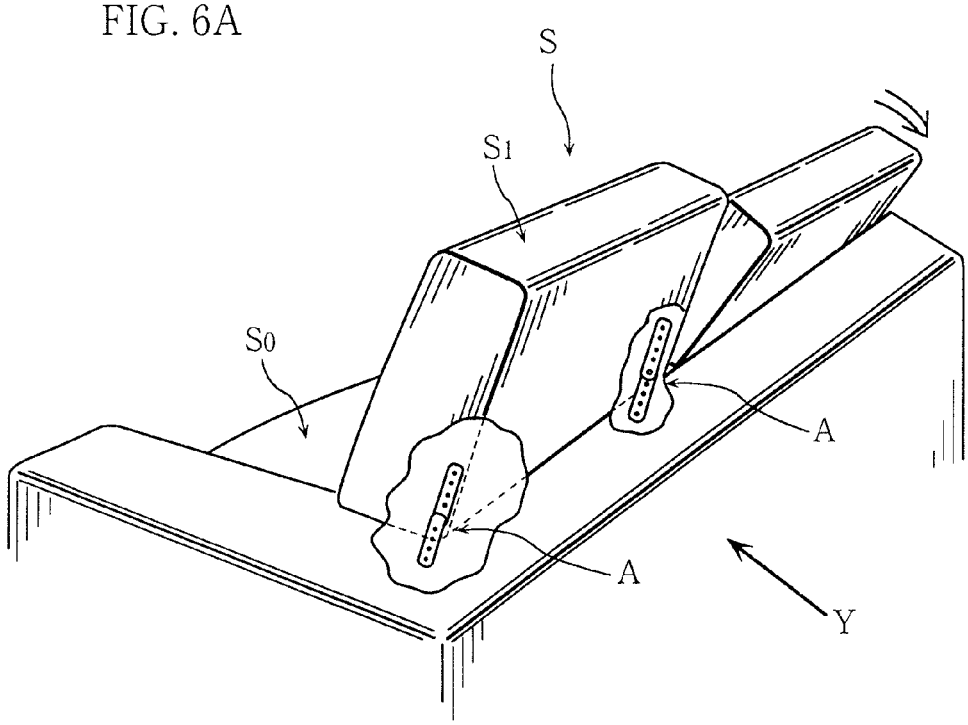
FIG. 6A is a perspective explanatory view with cross section of a principal portion showing a used state of the angle-adjustable hinge.
Figure 6B:
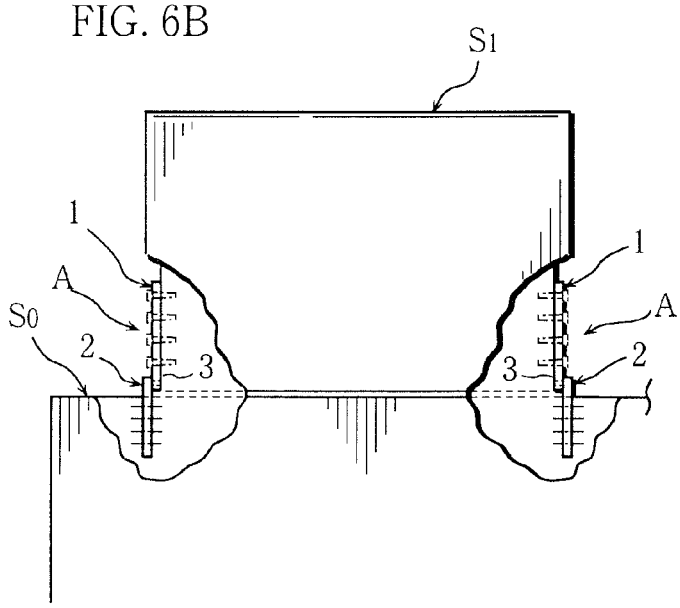
FIG. 6B is a perspective explanatory view with cross section of a principal portion showing the used state of the angle-adjustable hinge observed in a direction of an arrow Y.

An angle-adjustable hinge relating to the present invention is used for sofas, chairs, beds, headrests, footrests, oscillating doors, etc. to hold a member which oscillates (inclines) up and down with a predetermined angle range as to adjust the inclination angle. For example, the angle-adjustable hinge is applied to a sofa S as shown in FIGS. 6A and 6B to pivot a backrest $S_1$ to a seat $S_0$ as to freely incline backward.

An embodiment shown in FIGS. 1 through 4 is provided with a first member 1 having a first attachment portion 18 of plate shape and a second member 2 having a second attachment portion 19 of plate shape. Plural attachment small holes 15 are disposed on the first attachment portion 18 and the second attachment portion 19, fixation members such as screws and rivets are inserted to the attachment small holes 15 to fix each of frames of the backrest $S_1$ to the seat $S_0$ as shown with broken lines in FIG. 6B.

Figure 4:
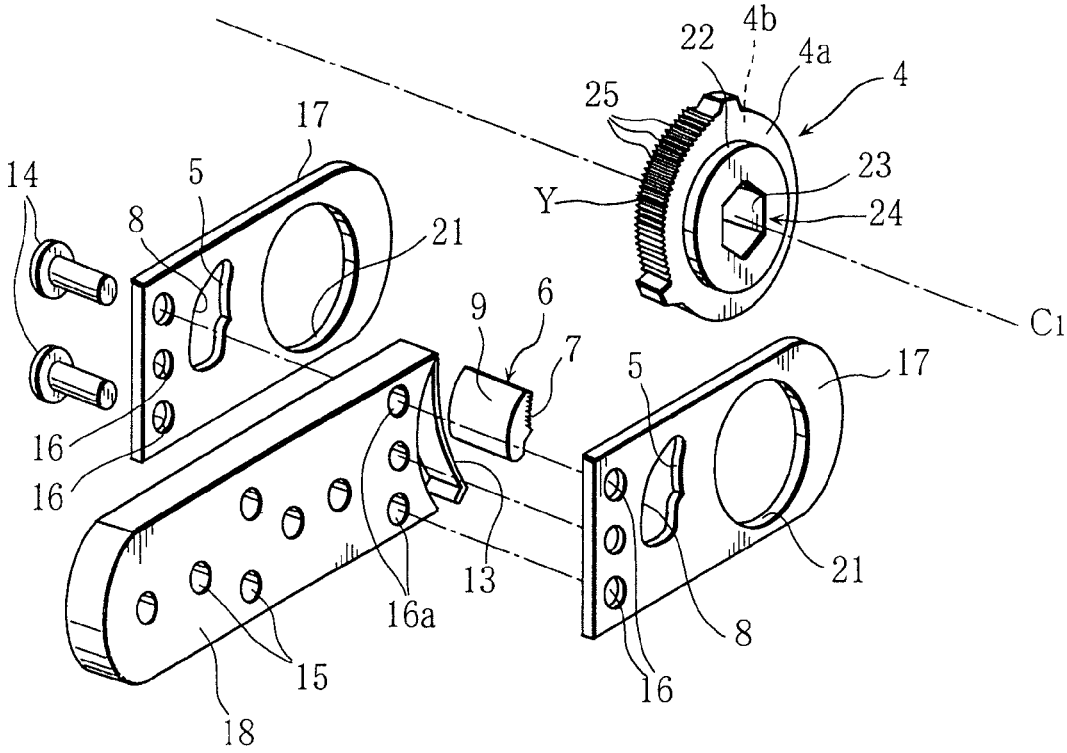
FIG. 4 is an exploded perspective view of a first member.

The first member 1 has a case portion 3 having a pair of facing plate portions 17, and an approximately disc-shaped gear member 4 is held within the case portion 3 as to freely rotate. As shown in FIG. 4, the facing plate portion 17 is approximately rectangular, two fixation holes are formed through the facing plate portion 17, two fixation holes 16*a* are formed through the first attachment portion 18, a caulking member 14 is inserted to the fixation holes 16 and 16*a* to firmly fix the first attachment portion 18 between the parallel two facing plate portions 17, and the case portion 3 is unitedly composed of a part of the first attachment portion 18 and the facing plate portions 17. (Although three fixation holes 16 on each of the facing plate portions 17 and three fixation holes 16*a* are shown in FIG. 4, the middle ones are for a mutual connecting rod of later-described cover K.)

And, a wedge-shaped window portion 5 and a circular holding hole 21 are formed through each of the facing plate portions 17 forming the case portion 3. A mark 6 represents a floating wedge member having a lateral dimension equal to or slightly larger than a dimension between outer faces of the facing plate portions 17. The floating wedge member 6 is inserted as to bridge the left and right wedge-shaped window portions 5, and assembled as to move within the wedge-shaped window portions 5.

In the gear member 4, a circular low protrusion 24 having a sliding peripheral face 22 is formed unitedly with (continuing from) each of side faces 4*a* and 4*b* as to protrude. The circular low protrusion 24 is fit to the circular holding hole 21 by the above-mentioned screwing (caulking) of the caulking members 14. That is to say, the sliding peripheral face 22 of the circular low protrusion 24 is fit to (held by) the circular holding hole 21 of each of the facing plate portions 17 as to be slidable with extremely low contact pressure. Therefore, the gear member 4 is held within the case portion 3 as to rotate around a first axis $C_1$.

A fitting shaft portion 20, non-circular such as regular hexagonal, polygonal, asterisk, etc., is unitedly formed with an end of the second member 2 as to laterally protrude. A female screw hole 29 is formed along an axis of the fitting shaft portion 20.

Many small concave-convex gear teeth 25 are disposed on an arc-shaped range having a central angle of the peripheral face less than 180°. on the gear member 4. That is to say, the gear member 4 has an arc-shaped outer toothed face Y. And, the gear member 4 is provided with a through hole 23 having a non-circular configuration such as regular hexagonal, polygonal, asterisk, etc., corresponding to the fitting shaft portion 20. And, the fitting shaft portion 20 of the second member 2 can be inserted to the through hole 23 from both sides in the direction of the axis $C_1$.

Figure 1:
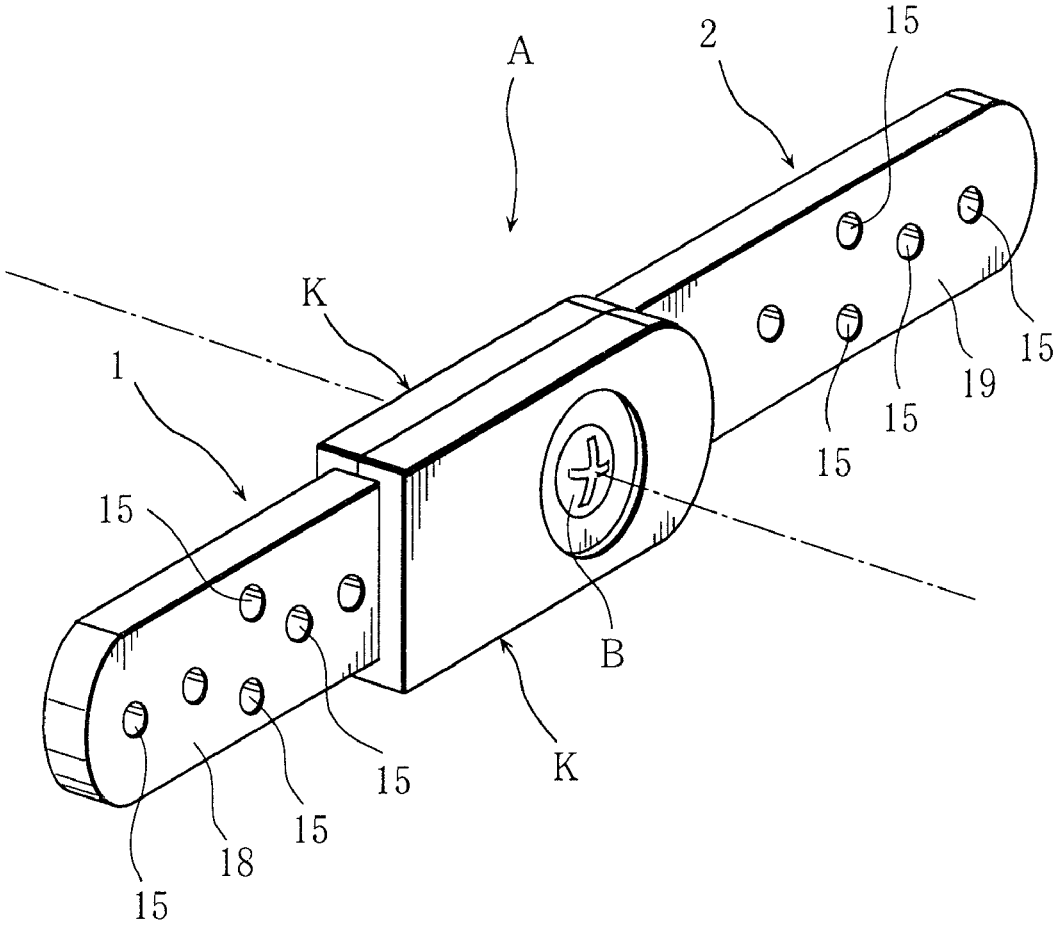
FIG. 1 is a whole perspective view of an embodiment of an angle-adjustable hinge of the present invention.
Figure 2:
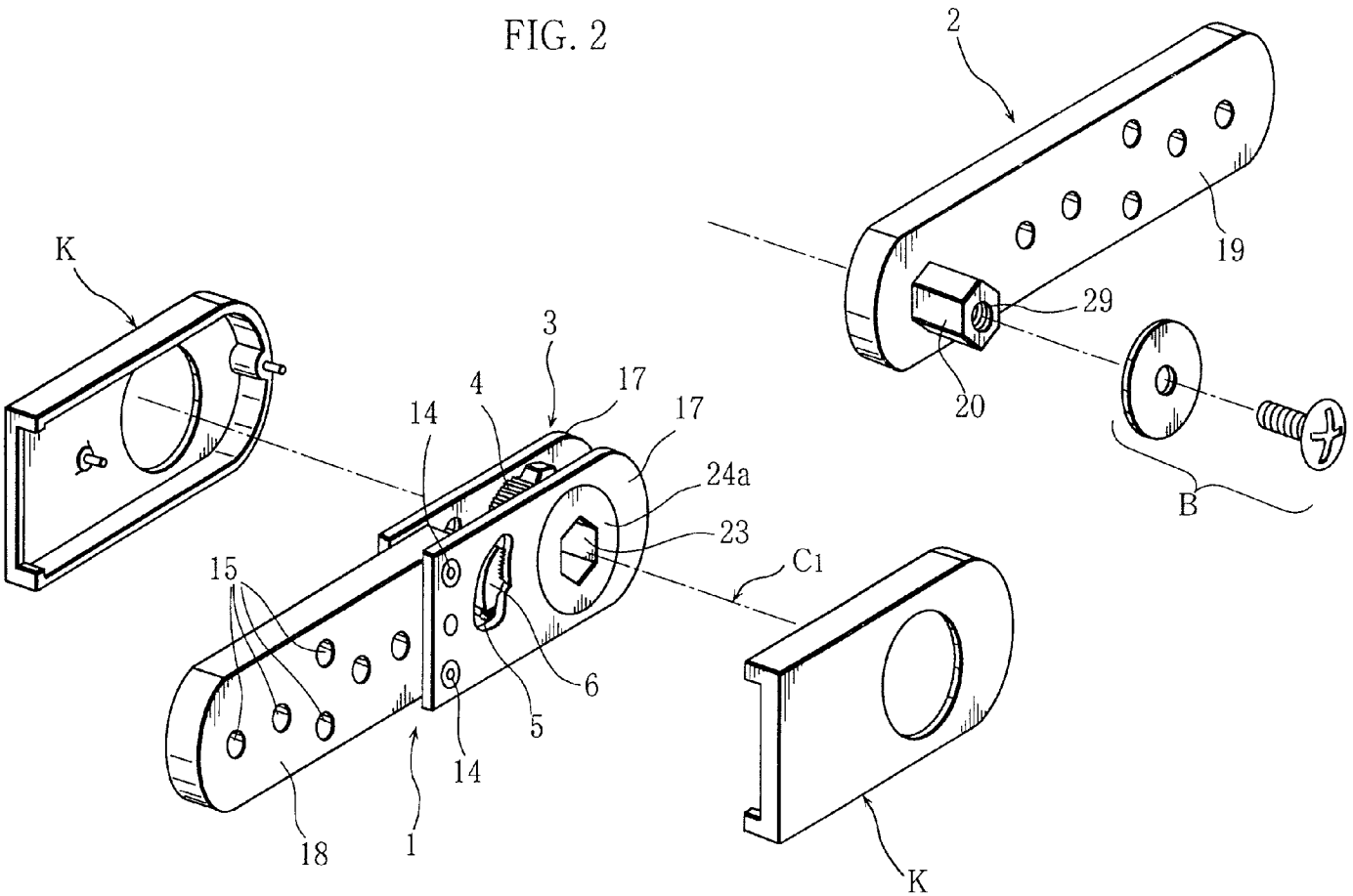
FIG. 2 is a whole exploded perspective view of the angle-adjustable hinge.

As shown in FIGS. 1 through 3, the second member 2 is formed as to be symmetric when inverted for 180° around a central axis in longitudinal direction, a member having this configuration can serve as both of the second member 2 and the first member 1.

As shown in FIG. 4 and FIG. 3, a part of the first attachment portion 18 and the gear member 4 are held between the pair of facing plate portion 17, the caulking members 14 are inserted to the holes 16 and 16*a*, the case portion 3 is formed by caulking and the gear member 4 is pivoted (held) as to freely rotate simultaneously, and a later-described elastic member 13 is also assembled simultaneously. Then, (or before the above-mentioned caulking) the wedge member 6 is inserted to the left and right wedge-shaped window portions 5.

As shown in FIG. 2, the circular low protrusion 24 of the gear member 4 fit to the case portion 3 and the outer face of the facing plate portion 17 approximately form the same plane. That is to say, height dimension of the circular low protrusion 24 is set to be approximately same as thickness dimension of the facing plate portion 17. As shown in FIG. 2, a cover K made of plastic or thin metal plate is attached, and the fitting shaft portion 20 is inserted to the through hole 23 with stopping by a stopping member B.

Figure 5:
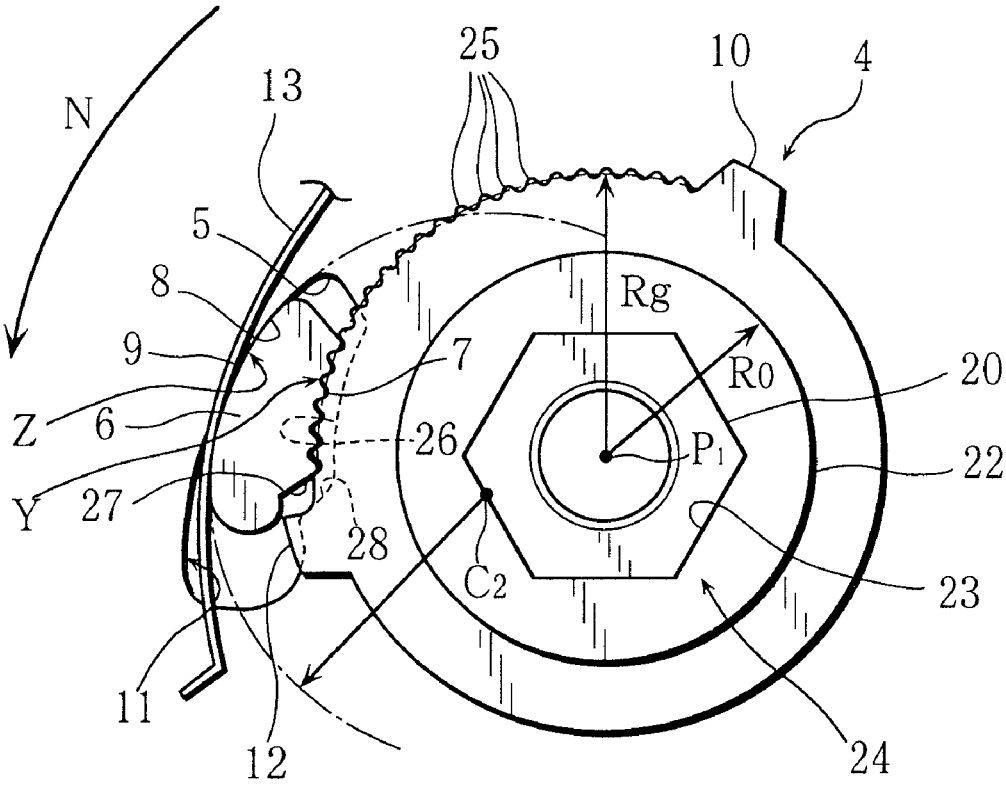
FIG. 5 is an enlarged explanatory view of a principal portion of the angle-adjustable hinge.

As shown in FIG. 5, the gear member 4 has the concave-convex gear teeth 25 from a push-back protrusion 10 protruding from the arc of which center is a center of axis $P_1$ of the through hole 23 along a range (of 100° to 120°) slightly (for 10° to 30°) over a quarter of circle)(90°) on the same arc in the direction of an arrow N. A push-out protrusion 12, protruding from the arc of which center is the center of axis $P_1$, is provided on the end portion of the range on which the concave-convex gear teeth 25 are formed.

A radius $R_0$ of the sliding peripheral face 22 of which center is the center of axis $P_1$ is set to be 60% to 80% to a gear radius Rg of the concave-convex gear teeth 25 (the outer toothed face Y) of which center is the center of axis $P_1$.

When the radius $R_0$ is set to be smaller than 60% to the gear radius Rg, the circular low protrusion 24 as an axis to the concave-convex gear teeth 25 becomes small, contact pressure becomes excessive, and cutting and abnormal abrasion may be generated for defects of engagement of the concave-convex gear teeth 25.

When the radius $R_0$ is set to be larger than 80% to the gear radius Rg, strength of remaining ring portions of the facing plate portions 17 as bearings is reduced.

As shown in FIGS. 3 through 5, the wedge-shaped window portion 5, formed to be concave to the center when the first axis $C_1$ is on the center side, is a wedge-shaped hole expanding in the arrow N direction. The wedge-shaped window portion 5 is formed on each of the facing plate portions 17 as to have the same configuration and penetrating the case portion 3. A wedge sliding face 8 is formed on an outer side of the wedge-shaped window portion 5. The wedge sliding face 8 is formed arc-shaped of which center is a second axis $C_2$ eccentric to the first axis $C_1$. The second axis $C_2$ may be an infinitely distant point and the whole or a part of the wedge sliding face 8 may be straight (not shown in Figures). That is to say, the configuration of the wedge sliding face 8 may be (i) arc-shaped, (ii) straight, (iii) combination of an arc and a straight line, (iv) a polygonal line in which plural straight short lines are serially connected, etc.

Further, the wedge-shaped window portion 5 has a retreat space 11 to store the floating wedge member 6 as to release the engagement of the inner toothed face 7 and the gear member 4 on an end portion on the side of the arrow N direction. The wedge-shaped window portion 5 has a contact staged portion 28 on an arc face 26 on the inner side.

One face side of the floating wedge member 6 is an inner toothed face 7 having concave-convex gear to engage with the gear member 4, and another face side of the floating wedge member 6 is a contact face 9 to contact the wedge sliding face 8 of the wedge-shaped window portion 5. On the inner toothed face 7, a guiding slope 27, which can contact the contact staged portion 28, is formed. The contact face 9 of the floating wedge member 6 is formed as an arc having approximately same configuration as the wedge sliding face 8. Although not shown in figures, the configuration of the contact face 9 may be (i) a polygonal line in which plural straight short lines are serially connected, (ii) a configuration in which straight short lines and arc-shaped short lines are serially connected.

Further, the case portion 3 is provided with an elastic member 13 to elastically push the floating wedge member 6 toward the gear member 4. The elastic member 13 is a plate spring composed of a strip of steel plate, of which both ends are attached to the first attachment portion 18, contacts a middle portion of the contact face 9 of the floating wedge member 6. The floating wedge member 6 is disposed in a space Z formed between the gear member 4 and the wedge sliding face 8, and elastically pushed toward the gear member 4.

Although one wedge-shaped window portion 5 is formed with one plate portion 17 in the construction described above, it is also possible to compose the wedge-shaped window portion 5 with two or more members (not shown in Figures). Further, it is sufficient that the wedge sliding face 8 is composed as to form the wedge-shaped space Z between the wedge sliding face 8 and the arc-shaped outer toothed face Y of the gear member 4 when observed in the axis $C_1$ direction. The space Z does not need to be closed like a window (not shown in Figures).

Next, use (function) of the above-described angle-adjustable hinge of the present invention is described.

FIGS. 7A through 12 are explanatory views of function of the angle-adjustable hinge A. The first member and the second member 2 in a straight state (with oscillation start angle $\phi_0=0°$ in FIG. 7A begin oscillation around the first axis $C_1$. The second member 2 oscillates against the first member 1 gradually in the arrow N direction (FIGS. 8A through 9B). As shown in FIG. 10A, the first member 1 and the second member 2 oscillate until a mutual right angle state (with oscillation end angle $\phi_1=95°$, and the oscillation in the arrow N direction ends. Then, as shown in FIG. 11A, the second member 2 oscillates in an arrow R direction to recover the straight state. The movement of the angle-adjustable hinge A is described below with this cycle.

Figure 7A:
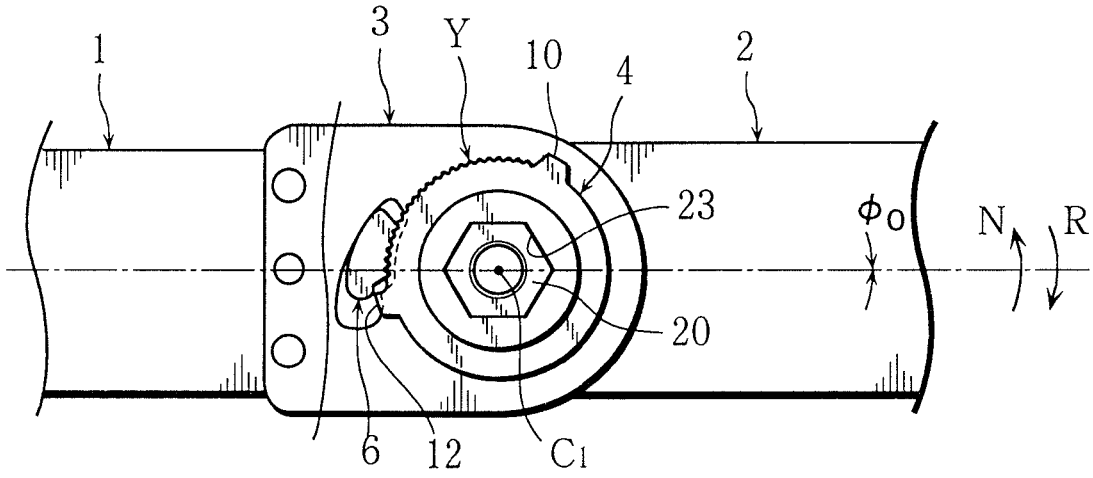
FIG. 7A is a cross-sectional view of a principal portion for functional explanation of the angle-adjustable hinge.
Figure 7B:
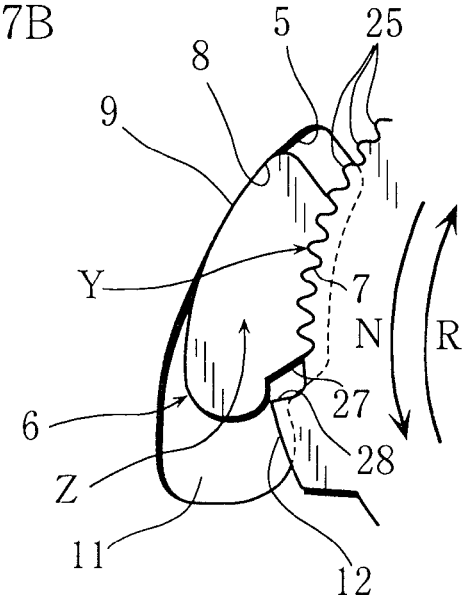
FIG. 7B is an enlarged view of a principal portion for functional explanation of the angle-adjustable hinge.

First, as shown in FIGS. 7A and 7B, the fitting shaft portion 20 is fit to the through hole 23 of the first member 1 to attach the second member 2 to the first member 1 as the first member 1 and the second member 2 are in a straight line (refer to FIG. 7A). In this case, the floating wedge member 6 engages with the concave-convex gear teeth 25 on the push-out protrusion 12 side by the inner toothed face 7 and contacts the wedge sliding face 8 by the contact face 9 to restrict the rotation of the gear member 4 in the arrow R direction (refer to FIG. 7B). This state is an oscillation starting state in which the angle formed by the first member 1 and the second member 2 is the oscillation start angle $\phi_0$. In the oscillation starting state, the second member 2 oscillates against the first member 1 in the arrow N direction.

Figure 8A:
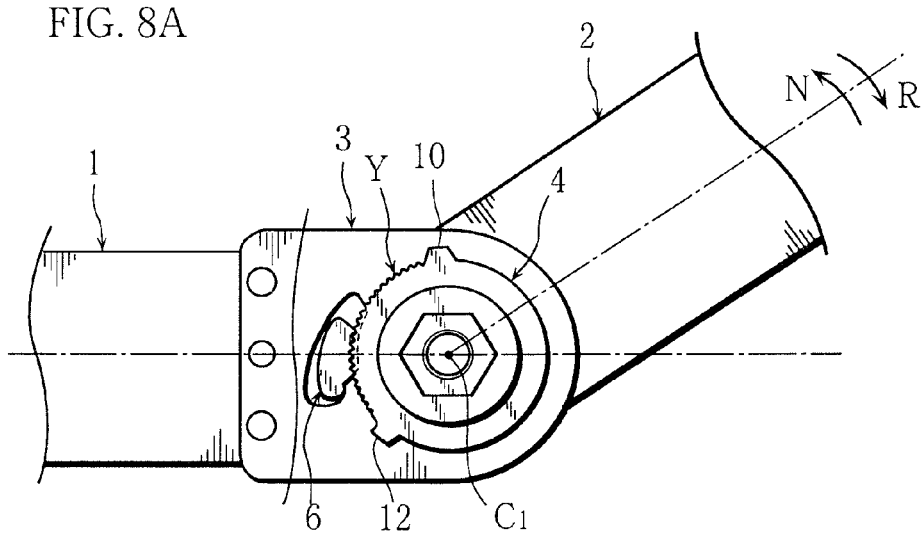
FIG. 8A is a cross-sectional view of the principal portion for functional explanation of the angle-adjustable hinge.
Figure 8B:
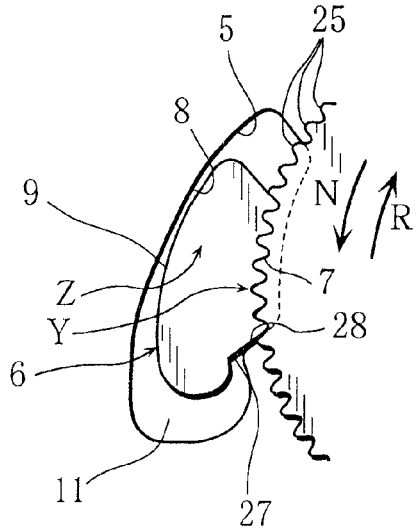
FIGS. 8B and 8C are enlarged views of the principal portion for functional explanation of the angle-adjustable hinge.
Figure 8C:
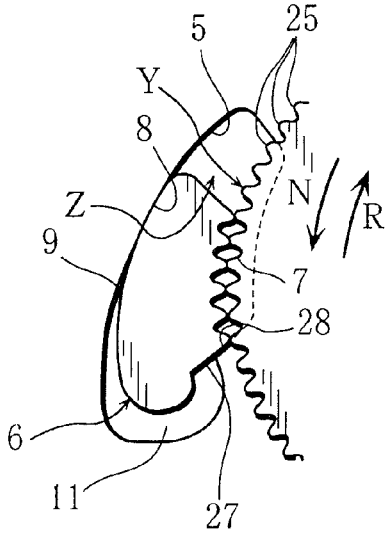

Next, as shown in FIGS. 8A through 8C, when the second member 2 is raised in the arrow N direction, the contact face 9 of the floating wedge member 6, elastically pushed toward the gear member 4 by the elastic member 13, slightly parts from the wedge sliding face 8 to make a gap d (refer to FIG. 8B). Then, as the raising movement continues, the guiding slope 27 of the floating wedge member 6 contacts the contact staged portion 28 of the wedge-shaped window portion 5 as shown in FIG. 8C, the floating wedge member 6 parts from the gear member 4 for the gap d, and the inner toothed face 7 goes over the concave-convex teeth 25 with click sound.

In this case, the floating wedge member 6 engages with the concave-convex gear teeth 25 by the inner toothed face 7 and contacts the wedge sliding face 8 by the contact face 9 to restrict the rotation of the second member 2 in the arrow R direction. Therefore, the second member 2 is kept with a desired inclination angle. The sliding peripheral face 22 broadly slides on the circular holding hole 21 to firmly keep the posture of the second member 2 because the gear member 4 is held by the circular low protrusion 24 fit to the circular holding hole 21.

Figure 9A:
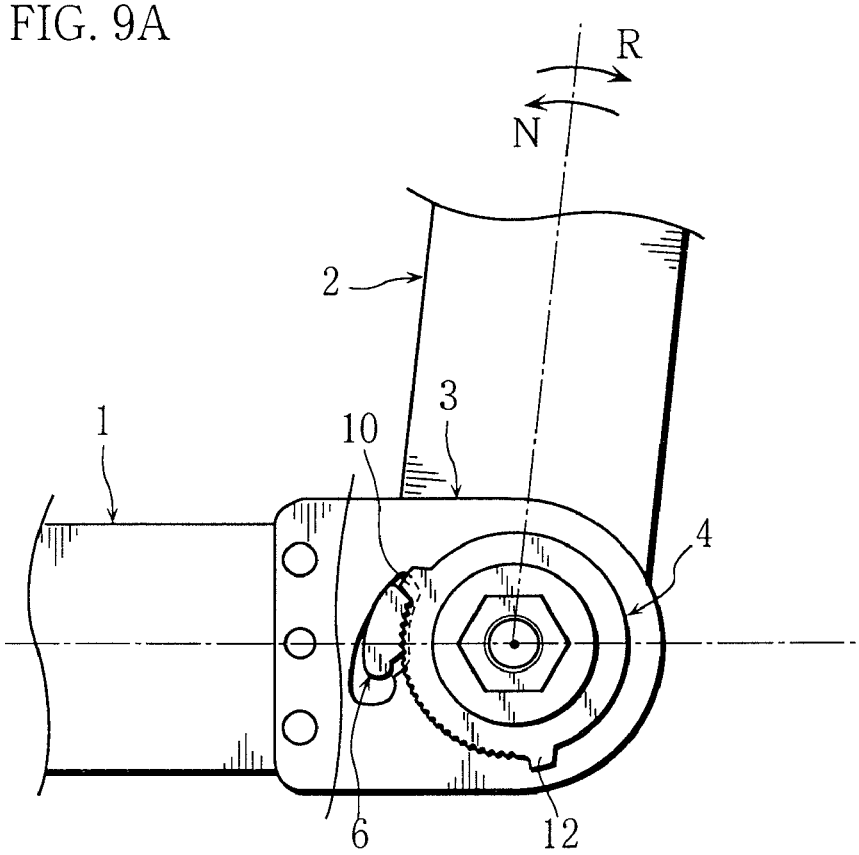
FIG. 9A is a cross-sectional view of the principal portion for functional explanation of the angle-adjustable hinge.
Figure 9B:
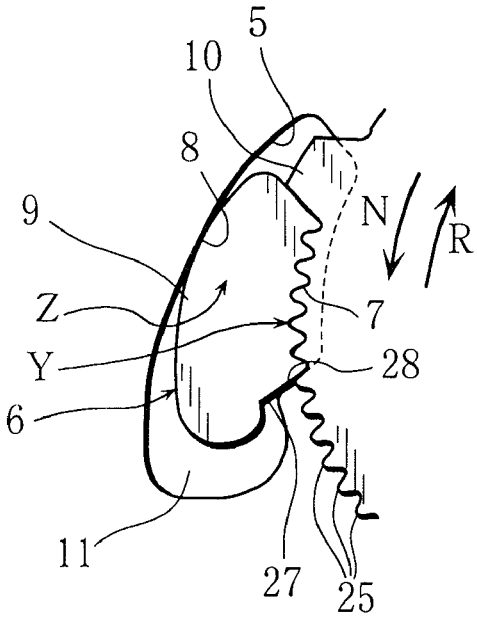
FIG. 9B is an enlarged view of the principal portion for functional explanation of the angle-adjustable hinge.

As shown in FIG. 9A, raising the second member 2, the floating wedge member 6 contacts the push-back protrusion 10, and the guiding slope 27 contacts the contact staged portion 28 (refer to FIG. 9B).

Figure 10A:
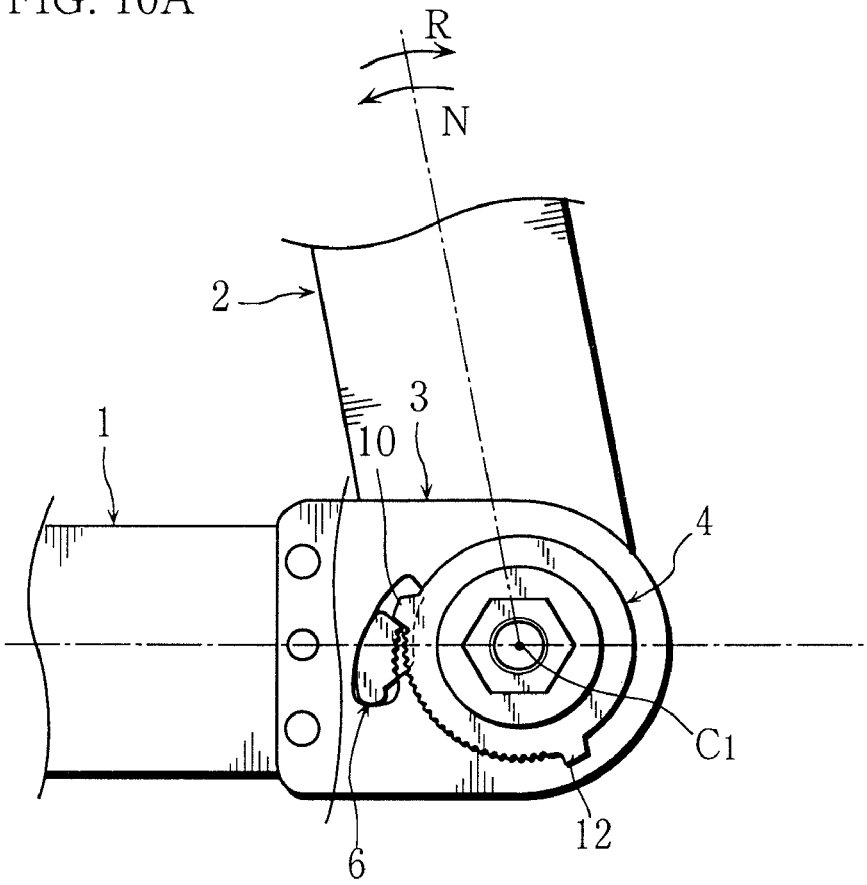
FIG. 10A is a cross-sectional view of the principal portion for functional explanation of the angle-adjustable hinge.
Figure 10B:
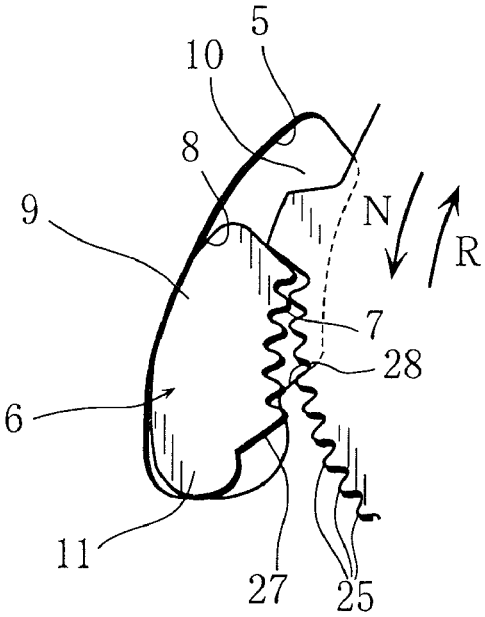
FIG. 10B is an enlarged view of the principal portion for functional explanation of the angle-adjustable hinge.

Then, as shown in FIGS. 10A and 10B, when the second member 2 is oscillated in the arrow N direction further, the floating wedge member 6, pushed back by the push-back protrusion 10 against the elastic force of the elastic member 13, parts from the gear member 4, goes over the contact staged portion 28, and becomes stored within the retreat space 11. That is to say, the engagement of the inner toothed face 7 and the concave-convex gear teeth 25 is released by the floating wedge member 6 parting from the gear member 4. And, the floating wedge member 6 hitches the gear member 4 to restrict the rotation in the arrow N direction.

This state is an oscillation ending state in which the angle formed by the first member 1 and the second member 2 is the oscillation end angle $\phi_1$. In the oscillation ending state, the second member 2 does not oscillate against the first member 1 in the arrow N direction beyond the oscillation end angle $\phi_1$.

Figure 11A:
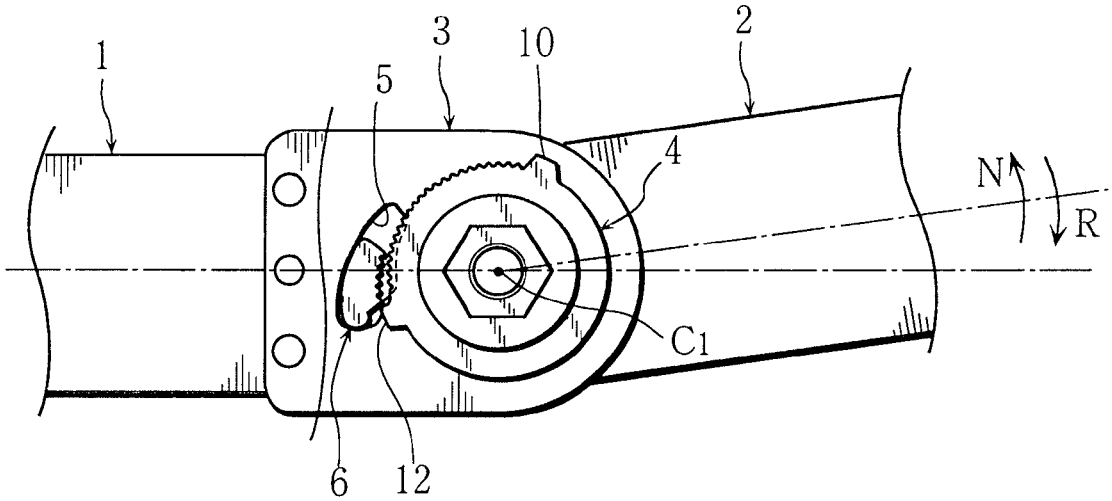
FIG. 11A is a cross-sectional view of the principal portion for functional explanation of the angle-adjustable hinge.
Figure 11B:
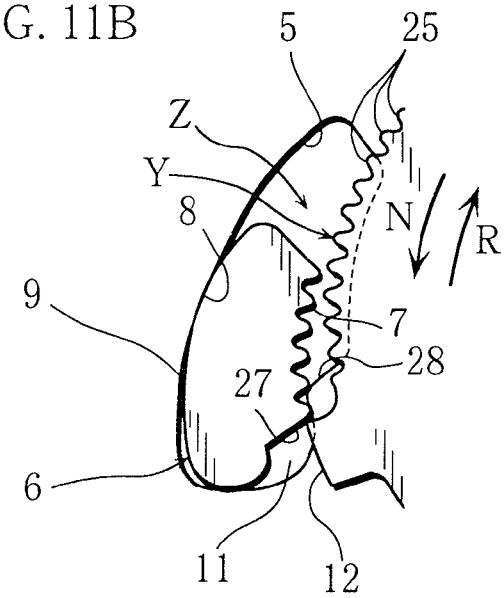
FIG. 11B is an enlarged view of the principal portion for functional explanation of the angle-adjustable hinge.

Therefore, the engagement of the inner toothed face 7 and the concave-convex gear teeth 25 is released, and the second member 2 becomes free oscillation state to the first member 1 within the range from the oscillation start angle $\phi_0$ to the oscillation end angle $\phi_1$. And, as shown in FIGS. 11A and 11B, when the second member 2 is oscillated in the arrow N direction to make the first member 1 and the second member 2 in straight state (with the oscillation start angle $\phi_0$), the guiding slope 27 is pressed by the push-out protrusion 12 of the gear member 4, the floating wedge member 6 is pushed out of the retreat space 11, and the engagement of the inner toothed face 7 and the concave-convex gear teeth 25 of the gear member 4 is recovered.

Figure 12:
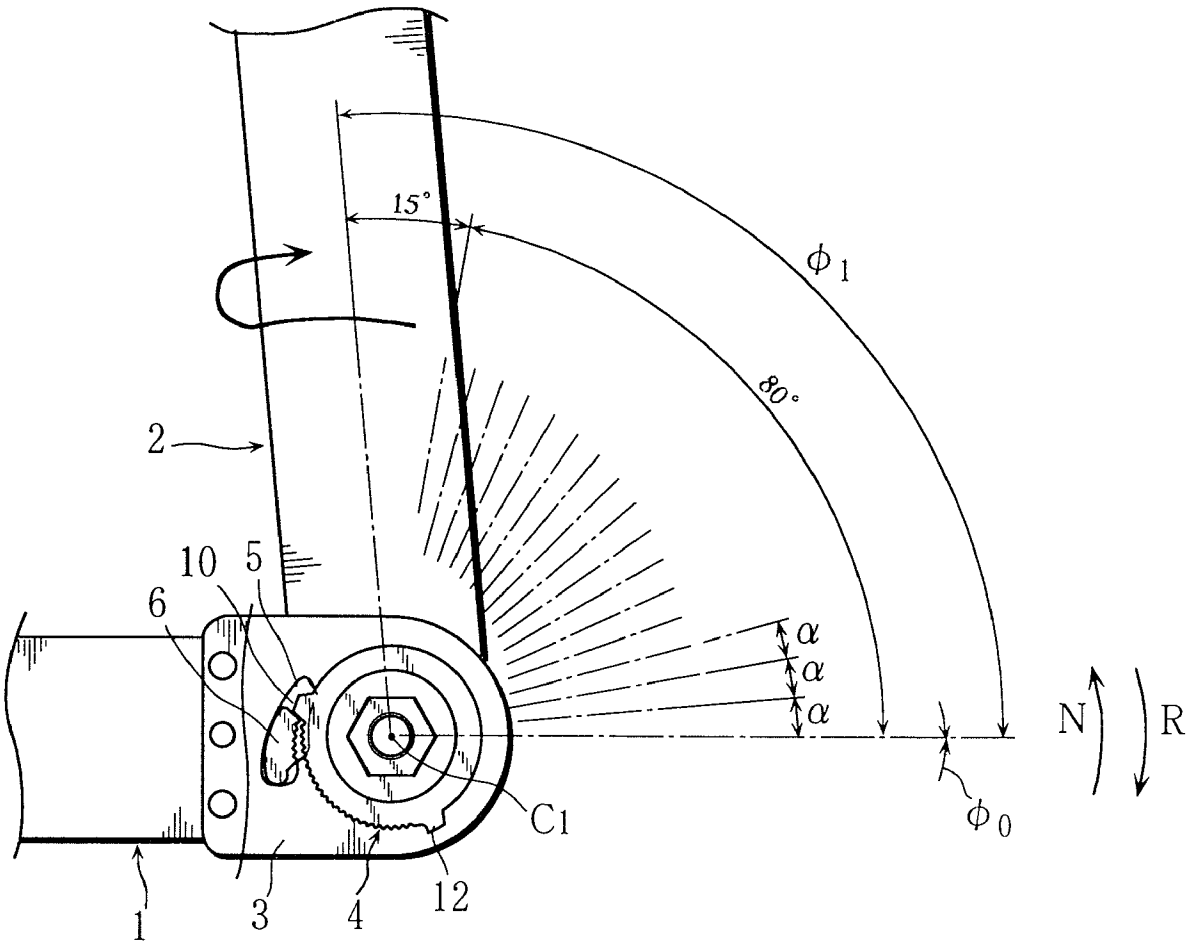
FIG. 12 is a functional explanatory view of the angle-adjustable hinge.

That is to say, as shown in FIG. 12, the second member 2 in the oscillation starting state, stopping the oscillation in the arrow R direction, is oscillated by an oscillation unit angle $\alpha$ in the arrow N direction, and kept with a desired inclination angle. When the inclination angle of the second member 2 against the first member 1 reaches for the oscillation end angle $\phi_1$ of the oscillation ending state, the second member 2 becomes free oscillation state within the range from the oscillation start angle $\phi_0$ to the oscillation end angle $\phi_1$. Then, the engagement of the floating wedge member 6 and the gear member 4 is recovered to return to the oscillation starting state by making the first member 1 and the second member 2 in straight state (with the oscillation start angle $\phi_0$).

In the present embodiment, although the oscillation start angle $\phi_0=0°$, the oscillation end angle $\phi_1=95°$, and the oscillation unit angle .alpha. as the oscillation angle when the inner toothed face 7 goes over one of the concave-convex gear teeth 25 is set to be 5°, these values are examples and may be changed.

And, the first attachment portion 18 and the second attachment portion 19 may be formed into desired configurations. For example, as shown in FIGS. 13A through 13D, the first member 1, provided with the case portion 3 to which the covers K are attached, may have configurations of the first attachment portion 18 different from the configuration used in the above-described embodiment. Also the second member 2 may similarly have configurations of the second attachment portion 19 different from the configuration used in the above-described embodiment.

The configurations of the first member 1 shown in FIGS. 13A through 13D and the configurations of the second member 2 shown in FIGS. 14A through 14D may be freely selected and combined, and various forms can be elected corresponding to uses of the angle-adjustable hinge A and fixation method of the first attachment portion 18 and the second attachment portion 19 to sofas, etc.

Figure 13A:
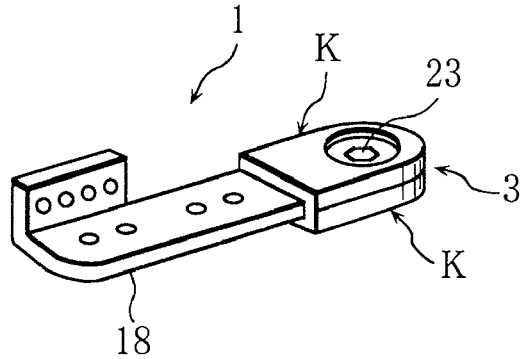
FIGS. 13A through 13D are perspective views showing other embodiments of the first member.
Figure 13B:
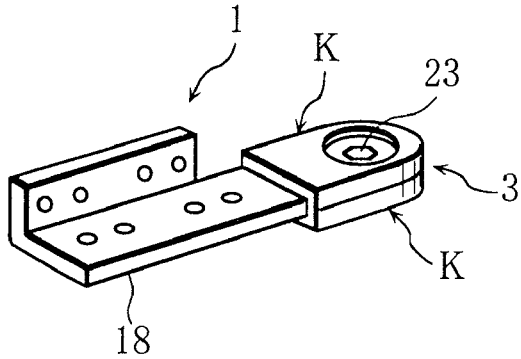
Figure 13C:
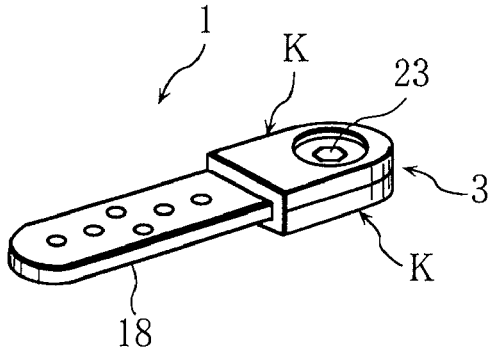
Figure 13D:
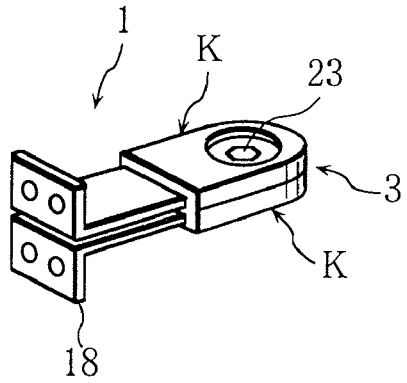
Figure 14A:
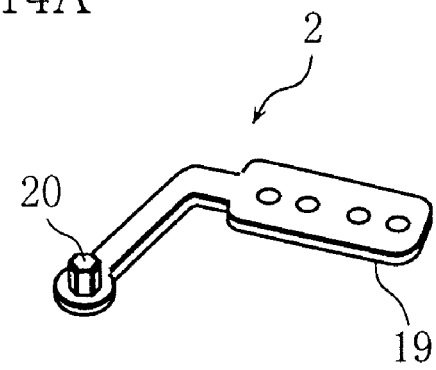
FIGS. 14A through 14D are perspective views showing other embodiments of the second member.
Figure 14B:
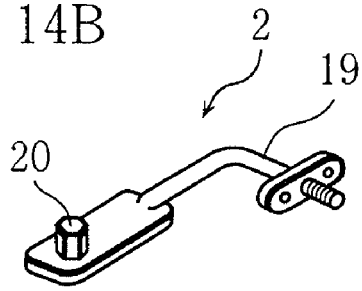
Figure 14C:
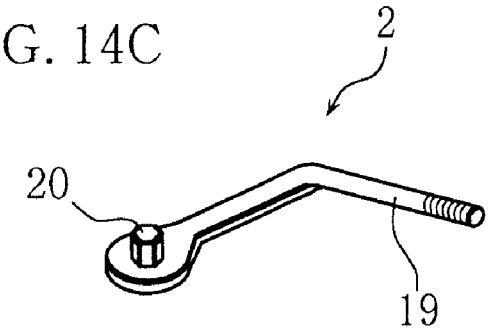
Figure 14D:
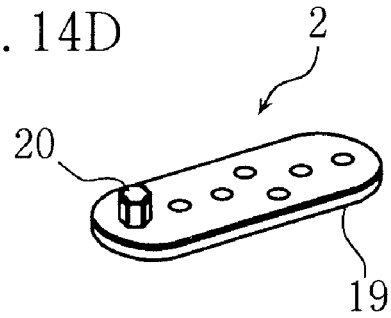

And, as shown in FIGS. 6A and 6B, in case that the angle-adjustable hinge A is attached to both of the left and right sides of the backrest $S_1$ of the sofa S, the fitting shaft portion 20 of the second member 2 is inserted from the left side to the through hole 23 on the first member 1 of the angle-adjustable hinge A on the left side, and the fitting shaft portion 20 of the second member 2 is inserted from the right side to the through hole 23 on the first member 1 of the angle-adjustable hinge A on the right side. That is to say, the fitting shaft portion 20 of the second member 2 can be inserted to the through hole 23 on the first member 1 from both of the left and right sides. Especially, when the configurations of FIGS. 13C and 14D, or FIGS. 13D and 14D are combined, the angle-adjustable hinges A can be composed of entirely common parts. And, also in combinations of FIG. 13A or 13B and FIG. 14A, 14B, or 14C, although it is necessary to make the first attachment portion 18 and the second attachment portion 19 symmetric corresponding to each other, functional parts assembled within the case portion 3 of the first member 1, especially difficult to make and expensive for the required working accuracy, material, and heat treatment, can be commonly used as they are.

Figure 15:
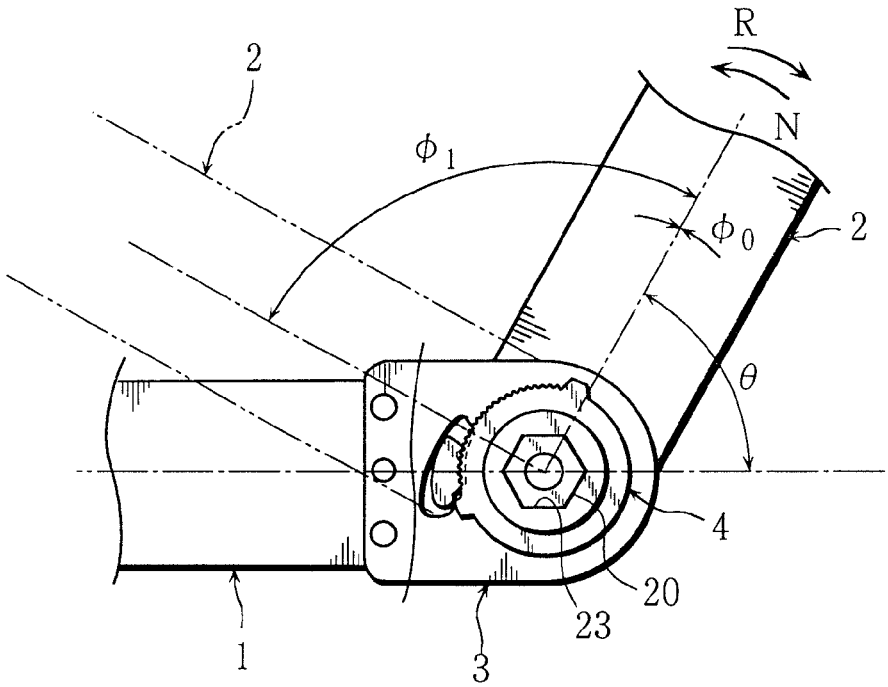
FIG. 15 is an explanatory view of angle adjustment of the angle-adjustable hinge.
Figure 16:
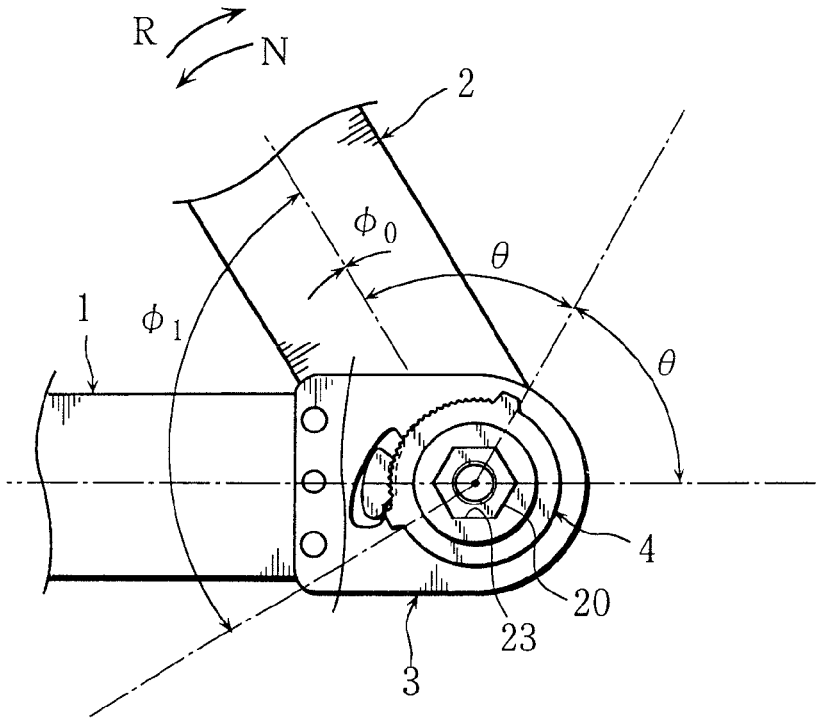
FIG. 16 is an explanatory view of angle adjustment of the angle-adjustable hinge.

Next, as shown in FIG. 15 and FIG. 16, a case, in which the second member 2 is attached to the first member 1 with inclination of a predetermined angle θ in the oscillation starting state, is described. In this case, the through hole 23 is a regular hexagonal hole and the fitting shaft portion 20 is a regular hexagonal rod, so θ=60° and the angle can be changed.

As shown in FIG. 15, the oscillation start angle $\phi_0$ is changed as the second member 2 with inclination of the predetermined angle θ starts the oscillation against the first member 1 in the arrow N direction. The movable area from the oscillation start angle $\phi_0$ to the oscillation end angle $\phi_1$ is same as in the above-described embodiment. Therefore, the oscillation end angle $\phi_1$ is inclined in the arrow N direction for the predetermined angle θ. As described above, the oscillation start angle $\phi_0$ and the oscillation end angle $\phi_1$ of the second member 2 against the first member 1 are changed for the predetermined angle θ.

And, as shown in FIG. 16, when the oscillation start angle $\phi_0$ is further changed by further inclination of the second member 2 for the predetermined angle θ in the arrow N direction, the oscillation end angle ϕ is further inclined for the predetermined angle θ in the arrow N direction. That is to say, the oscillation start angle $\phi_0$ and the oscillation end angle $\phi_1$ can be changed for every predetermined angle θ, and the oscillation start angle $\phi_0$ and the oscillation end angle $\phi_1$ of the second member 2 against the first member 1 can be changed corresponding to uses.

The present invention can be modified. For example, the configurations of the through hole 23 and the fitting shaft portion 20, not restricted to regular hexagon, may be preferably regular triangle, square, regular polygonal such as regular octagonal, other non-circular configurations such as cross, asterisk, etc.

As described above, the first member 1 and the second member 2 can be easily connected because the first member 1 holding the approximately disc-shaped gear member having the non-circular through hole 23 as to freely rotate around an axis $C_1$ of the through hole 23, and the second member 2 on which the fitting shaft portion 20 detachably inserted to the through hole 23 of the gear member 4 is protruding, are provided, the wedge sliding face 8 is disposed on the first member 1 side to form the wedge-shaped space Z between the wedge sliding face 8 and the arc-shaped outer toothed face Y of the gear member 4 when observed in the direction of the axis $C_1$, the floating wedge member 6, of which one face side is an arc-shaped inner toothed face 7 engaged with the outer toothed face Y of the gear member 4 and the outer face side is the contact face 9 to contact the wedge sliding face 8, and movable within the wedge-shaped space Z, is provided, the contact face 9 of the floating wedge member 6 contacts the wedge sliding face 8, the inner toothed face 7 engages with the outer toothed face Y, and oscillation of the gear member 4 in one direction toward the first member 1 is restricted by wedge work of the floating wedge member 6 between the outer toothed face Y and the wedge sliding face 8. Further, when the design must be changed as to correspond to uses, the hinge can easily correspond to the design change with common use of the case portion 3, the production is made easy, and the quality is kept high because expensive functional parts which require the most high standards of working accuracy, material, heat treatment, etc. can be assembled within the case portion 3 of the first member 1. And, adjustment of the oscillation start angle $\phi_0$ and the oscillation end angle $\phi_1$ of the second member 2 against the first member 1 can be easily conducted to enlarge the uses.

And, the construction and configurations of the wedge sliding face 8 and members near the wedge sliding face 8 can be simplified to make the product light weight and compact because the first member 1 has the case portion 3, the wedge-shaped window portion 5 is formed on the case portion 3, and the wedge sliding face 8 is composed of a part of the wedge-shaped window portion 5.

And, the first member 1 and the second member 2 can be easily connected only by the insertion of the fitting shaft portion 20 of the second member 2 to the through hole 23 of the first member 1 because the present invention is provided with the first member 1 provided with the case portion 3 holding the approximately disc-shaped gear member having the non-circular through hole 23 as to freely rotate, the second member 2 on which the fitting shaft portion 20, detachably inserted to the through hole 23 of the gear member 4, is protruding, the wedge-shaped window portion 5 formed on the case portion 3, and the floating wedge member 6, movably disposed within the wedge-shaped window portion 5, in which one side face is an inner toothed face 7 to engage with the gear member 4 and another side is the contact face 9 to contact the wedge sliding face 8 of the wedge-shaped window portion 5, to restrict the gear member 4 from oscillation in one direction against the case portion 3 by the engagement of the inner toothed face 7 with the gear member 4 and the contact of the contact face 9 and the wedge sliding face 8. And, when the design must be changed as to correspond to uses, the hinge can easily correspond to the design change with common use of the case portion 3, the production is made easy, and the quality is kept high because expensive functional parts which require the most high standards of working accuracy, material, heat treatment, etc. can be assembled within the case portion 3 of the first member 1. And, adjustment of the oscillation start angle $\phi_0$ and the oscillation end angle $\phi_1$ of the second member 2 against the first member 1 can be easily conducted to enlarge the uses.

Figure 17:
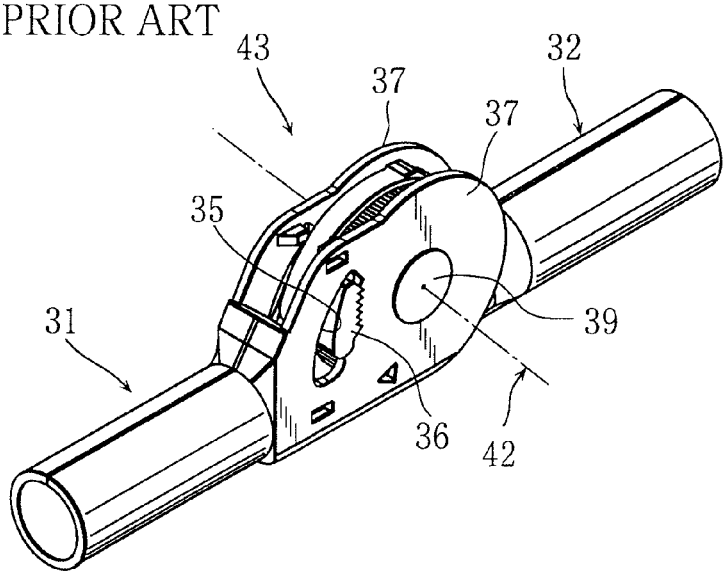
FIG. 17 PRIOR ART
FIG. 17 is a perspective view showing a conventional example.
Figure 18:
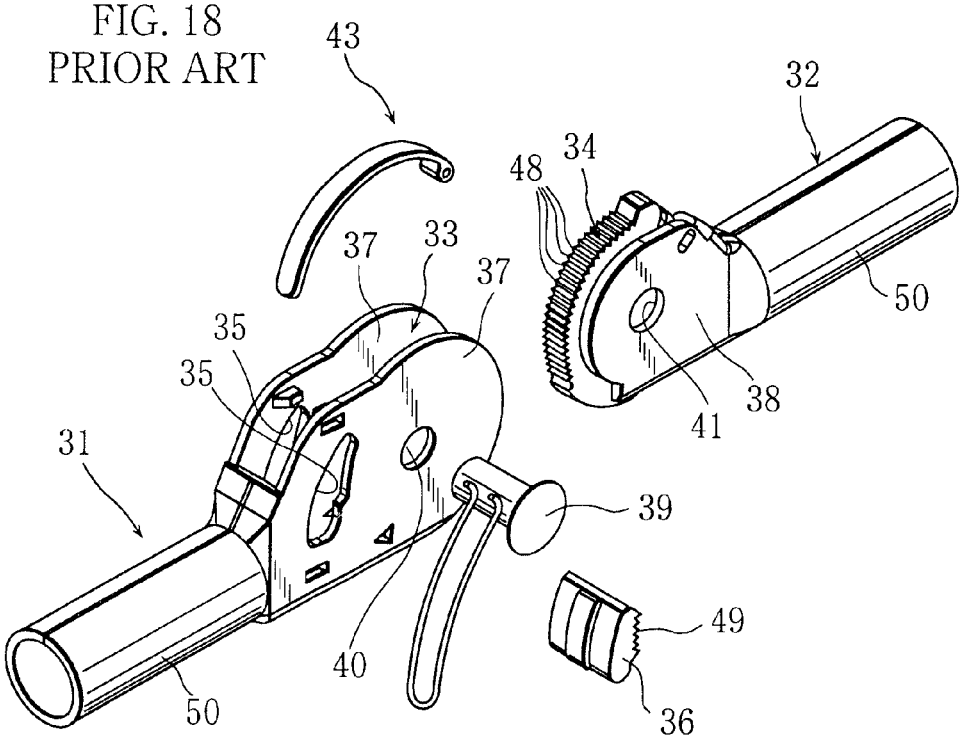
FIG. 18 PRIOR ART
FIG. 18 is an exploded perspective view showing the conventional example.

And, the early abrasion of the small pin 39 and the small hole portion 40, described with the conventional FIG. 17 and FIG. 18, can be prevented, accompanying abnormal abrasion and cutting of the gear teeth can be prevented, and the hinge is excellent in durability because the circular low protrusion 24 having the sliding peripheral face 22 is protruding from the side face 4*a* and the side face 4*b* on the gear member 4, and the case portion is provided with the pair of facing plate portions 17 each of which has the circular holding hole 21 to which the sliding peripheral face 22 of the circular low protrusion 24 is slidably fit.

And, when the configurations of arms on left and right sides are different, many parts can be commonly used as to correspond to uses because the fitting shaft portion 20 of the second member 2 is composed as to be inserted to both of left and right sides of the through hole 23 of the first member 1.

And, adjustment of the oscillation start angle $\phi_0$ and the oscillation end angle $\phi_1$ can be easily conducted only with attachment and detachment of the first member 1 and the second member 2, and the hinge can be used without restriction of use because the non-circular through hole 23 is regular polygonal, and each of the oscillation start angle $\phi_0$ and the oscillation end angle $\phi_1$ of the second member 2 against the first member 1 can be changed for the predetermined angle $\theta$.

And, contact pressure against the sliding peripheral face 22 is reduced, abrasion is barely generated, axial deviation of the gear member 4 is prevented, and the concave-convex gear teeth 25 and the inner toothed face 7 can be certainly engaged because the radius $R_0$ of which center is the center of axis $P_1$ of the sliding peripheral face 22 is set to be 60% to 80% of the gear radius Rg of the concave-convex gear teeth 25 of which center is the center of axis $P_1$ of the through hole 23 in the gear member 4.

While preferred embodiments of the present invention have been described in this specification, it is to be understood that the invention is illustrative and not restrictive, because various changes are possible within the spirit and indispensable features.

What is claimed is:

1. An angle-adjustable hinge comprising:

an approximately disc-shaped gear member having a non-circular through hole;

a first member having a case portion provided with means for holding the gear member for free rotation around an axis of the through hole;

a second member on which a fitting shaft portion detachably inserted to the through hole of the gear member is protruding;

a wedge sliding face is disposed on the first member to form a wedge-shaped space between the wedge sliding face and an arc-shaped outer toothed face of the gear member when observed in the direction of the axis;

a floating wedge member, of which one face side is an arc-shaped inner toothed face to engage with the outer toothed face of the gear member and an outer face side is a contact face to contact the wedge sliding face, and the floating wedge member movable within the wedge-shaped space; and when the contact face of the floating wedge member contacts the wedge sliding face, and the inner toothed face engages with the outer toothed face, oscillation of the gear member in one direction toward the first member is restricted by wedging of the floating wedge member between the outer toothed face and the wedge sliding face.

2. The angle-adjustable hinge as set forth in claim 1, wherein a wedge-shaped window portion is formed on the case portion, and the wedge sliding face is composed of a part of the wedge-shaped window portion.

3. The angle-adjustable hinge as set forth in claim 2, wherein a circular low protrusion having a sliding peripheral face is protruding from a side face and another side face on the gear member, and the case portion means for holding the gear member is a pair of facing plate portions each of which has a circular holding hole to which the sliding peripheral face of the circular low protrusion is slidably fit.

4. The angle-adjustable hinge as set forth in claim 3, wherein a radius of which center is a center of axis of the sliding peripheral face is set to be 60% to 80% of a gear radius of concave-convex gear teeth of which center is the center of axis of the through hole in the gear member.

5. The angle-adjustable hinge as set forth in claim 1, wherein the fitting shaft portion of the second member is composed as to be insertable to both of left and right sides of the through hole of the gear member.

6. The angle-adjustable hinge as set forth in claim 1, wherein the non-circular through hole is polygonal, and each of an oscillation start angle and an oscillation end angle of the second member against the first member can be changed for a predetermined angle.

* * * * *